United States Patent [19]

Gretz et al.

[11] 4,309,879

[45] Jan. 12, 1982

[54] CHILD'S SIMULATED JEWELRY ITEM

[75] Inventors: Bonita M. Gretz, Manhattan Beach; J. Stephen Lewis, Pacific Palisades; Cyril G. Shireman, Rolling Hills Est., all of Calif.

[73] Assignee: Mattel, Inc., Hawthorne, Calif.

[21] Appl. No.: 191,985

[22] Filed: Sep. 29, 1980

[51] Int. Cl.[3] ..... A44C 17/02

[52] U.S. Cl. ..... 63/29 R

[58] Field of Search ..... 63/15, 15.5, 29 R; 40/10 D, 315, 331, 332, 622

[56] References Cited

U.S. PATENT DOCUMENTS

| | | | |
|---|---|---|---|
| 2,220,038 | 10/1940 | Kreisler et al. | 63/29 R |
| 2,413,541 | 12/1946 | Brady | 63/3 |
| 2,501,917 | 3/1950 | Reilly | 63/18 |
| 2,521,558 | 9/1950 | Alvarez | 63/29 R |
| 2,537,449 | 1/1951 | Evenson | 63/15 |
| 2,674,107 | 4/1954 | Bodnar | 63/29 R |

FOREIGN PATENT DOCUMENTS

| | | | |
|---|---|---|---|
| 1426265 | 12/1965 | France | 63/29 R |

*Primary Examiner*—F. Barry Shay

*Attorney, Agent, or Firm*—Ronald M. Goldman; Max E. Shirk; Roy A. Ekstrand

[57] ABSTRACT

A colored disc is positioned in a bezel beneath a clear, plastic simulated gem for imparting color to the gem; the bezel may be affixed to a band for use as a finger ring and a plurality of discs of different colors may be furnished with the ring so a child user may make her own simulated birthstone.

2 Claims, 3 Drawing Figures

CHILD'S SIMULATED JEWELRY ITEM

BACKGROUND OF THE INVENTION

1. Field of the Invention

This invention pertains generally to the field of simulated jewelry items for children and more particularly to a new and useful simulated jewelry item having a clear simulated gem beneath which may be placed a disc of a predetermined color to simulate a birthstone.

2. Brief Description of the Prior Art

Prior art known to applicants comprises the following U.S. patents:

| Patentee | U.S. Pat. No. | Date Issued |
|---|---|---|
| M. G. E. Rochas | 1,712,171 | May 7, 1929 |
| S. A. Wittmayer | 2,666,305 | Jan. 19, 1954 |
| A. Siegel et al. | 3,543,535 | Dec. 1, 1970 |
| C. Collica et al. | 3,983,717 | Oct. 5, 1976 |

Rochas discloses a ring having stones which may be removed by opening a door forming the bottom wall of the bezel.

Wittmayer discloses a ring having a frame which is hinged to the top of the ring and which has a plate swingably mounted therein. A first decoration is provided on one side of the plate presented to view.

Siegel et al. discloses a jewelry article base combined with a detachable ornament mounting wherein an ornament is detachably connected to a base and held in attached condition by separable, cooperably pivotal members and interchangeable locking means spaced from the pivotal members.

Collica et al. discloses a ring for housing a disc of radiation measuring material comprising a band having a circular shape; a housing integral with the band and formed in a surface thereof, the housing comprising a hollow, cylindrical section substantially normal to the band surface and terminating in an inwardly disposed annular flange which defines a substantially circular aperture. A retaining protrusion is formed on the inside of the cylindrical section and space from the annular flange is provided to retain a plurality of discs mounted in the housing in layered fashion.

SUMMARY OF THE INVENTION

This invention is directed, in brief, to the provision of a new and useful child's simulated jewelry item.

The best mode currently contemplated by applicants for carrying out the invention includes the provision of a bezel or housing having a bottom wall, an upstanding side wall or collar at least partially encompassing the bottom wall and an open top. A colored disc is positioned in the housing on the bottom wall and a clear, simulated gem is mounted in the open top in overlying relationship with the colored disc so that the gem will take on the color of the disc. The gem may have a facetted upper surface and a planar lower surface; a plurality of discs each having a different color may be supplied with the jewelry item and the gem may be removably coupled to the housing so that the color of the gem may be changed by changing the discs in the housing.

Additionally, a band may be affixed to the underside of the housing so that the simulated jewlery item may be worn as a finger ring. The simulated gem may include suitable prongs cooperating with openings in the housing in a manner such that it will be extremely difficult for a small child to remove the simulated gem from the housing once the gem has been snapped into position in the housing.

The child user may be supplied with a chart showing the colors of different birthstones so that the child may select a colored disc matching the color of her birthstone and insert it in the housing beneath the simulated gem.

The features of the present invention which are believed to be novel are set forth with particularity in the appended claims. The present invention, both as to its organization and manner of use, together with further objects and advantages thereof, may best be understood by reference to the following description, taken in connection with the accompanying drawing in which like reference characters refer to like elements in the several views.

DESCRIPTION OF THE PREFERRED EMBODIMENT

Figure 2:
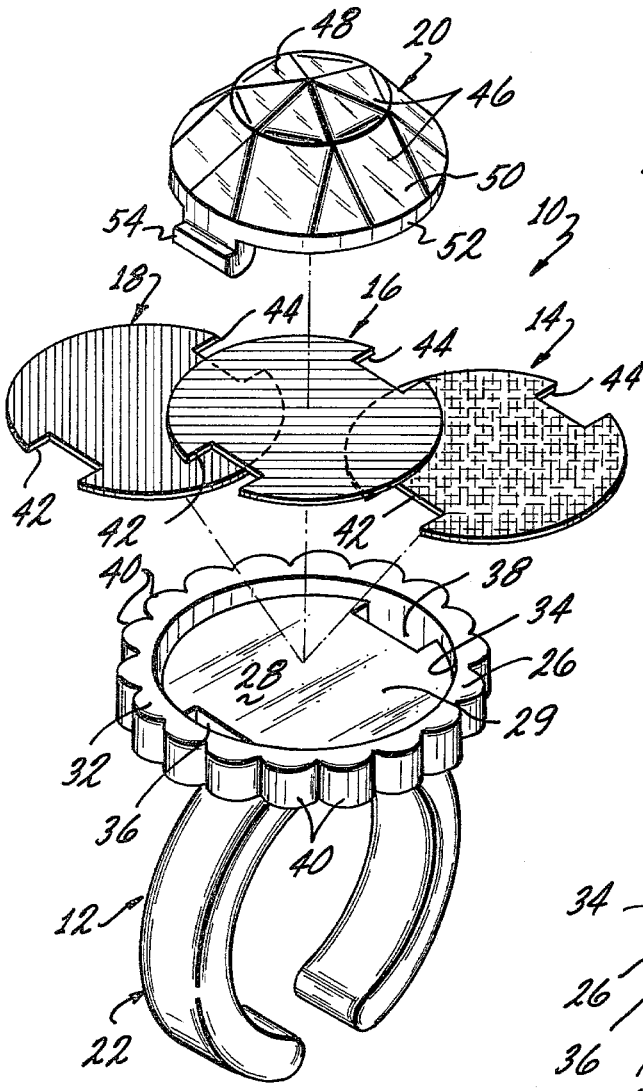
FIG. 2 is an exploded perspective view of the ring of FIG. 1.
Figure 1:
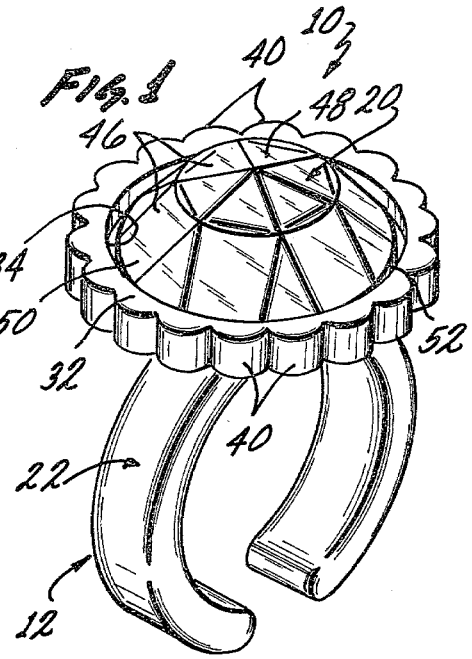
FIG. 1 is a perspective view of a child's simulated jewelry item constituting a presently-preferred embodiment of the invention.

Referring again to the drawing, a child's simulated jewelry item constituting a presently-preferred embodiment of the invention, generally designated 10, is shown herein for purposes of illustration, but not of limitation, in the form of a ring, having a body 12, a plurality of colored discs 14, 16, 18 and a simulated gem 20.

Body 12 may be molded as a one-piece part from a suitable polymeric material such as a polycarbonate material sold under the brand name "Lexan" by the General Electric Company; body 12 includes a band 22, a boss or transition section 24 and a bezel or housing 26.

Band 22 may be of opened, generally circular shaped and may have sufficient flexibility that it may be opened slightly for larger fingers or closed slightly for smaller fingers.

Bezel 26 includes a bottom wall 28 having an upper surface 29, lower surface 30, an upstanding side wall or collar 32 encompassing bottom wall 28 and an open top 34. A pair of elongated openings 36, 38 are provided in bottom wall 28 closely adjacent collar 32 and collar 32 may be suitably decorated with a plurality of scallops 40. Openings 36, 38 are preferably located 180° from each other in overlying relationship with band 22 for forming notches corresponding to similar notches 42, 44 provided in each disc 14, 16, 18.

If desired, discs 14, 16, 18 may be supplied in yellow, blue, and red colors, respectively. Additional discs may be supplied in other colors corresponding to the colors of different birthstones.

Figure 3:
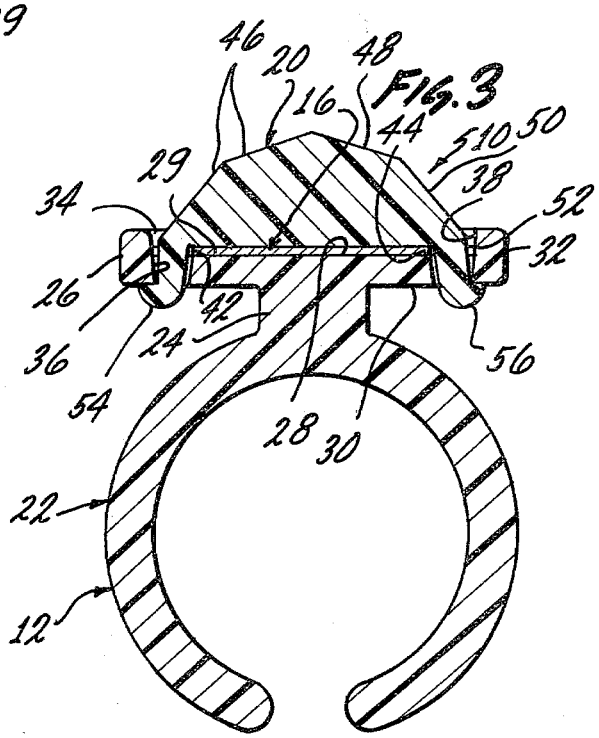
FIG. 3 is a cross-sectional view thereof.

Simulated gem 20 may be made from the same material as body 12 and is preferably clear so that it will take on the color of the disc positioned in bezel 26 on bottom wall 28. Additionally, simulated gem 20 may be provided with a plurality of facets 46 on its upper surface 48 and its frusto-conical sidewall 50 and a planar lower surface 52. Simulated gem 20 may also be provided with a pair of J-shaped hooks 54, 56 depending from planar surface 52 for securing simulated gem 20 to body 12 by passing hooks 54, 56 through openings 36, 38, respectively, in bottom wall 28. As shown in FIG. 3, hooks 54, 56 are naturally sprung outwardly so that they will engage the underside of collar 26 for securely affixing simulated gem 22 to bezel 26 in a manner such that a small child cannot accidentally remove simulated gem 20 from body 12 thereby creating an opportunity for a small child to place simulated gem 20 in her mouth and swallow it.

Discs 14, 16, 18 may be made from any suitable paper, metallic or plastic material, as will be apparent to those skilled in the art.

Simulated jewelry item 10 is preferably supplied to the child user in the disassembled form shown in FIG. 2. The child may then select a disc 14, 16 or 18 in her favorite color and place it in bezel 26 on bottom wall 28 and then snap the simulated gem 20 into position by inserting hooks or prongs 54, 56 through openings 36, 38, respectively, whereupon hooks 54, 56 will spring outwardly into engagement with the underside of collar 32, as shown in FIG. 3.

If desired, a book giving the colors of birthstones for each month may be supplied with simulated jewelry item 10 so that a child-user may select her own birthstone-color which will be imparted to simulated gem 20 when it is in position in bezel 26.

While the particular child's simulated jewelry item herein shown and described in detail is fully capable of attaining the objects and providing the advantages hereinbefore stated, it is to be understood that it is merely illustrative of the presently-preferred embodiment of the invention and that no limitations are intended to the details of construction or design herein shown other than as defined in the appended claims which form a part of this disclosure.

Whenever the term "means" is employed in these claims, this term is to be interpreted as defining the corresponding structure illustrated and described in the specification or the equivalent of the same.

What is claimed is:

1. A child's simulated jewelry item, comprising:

a unitary body including a band of opened, generally circular shape, a bezel having a bottom wall, a collar at least partially encompassing the upperside of said bottom wall and a boss connecting the underside of said bottom wall to said band, said body being molded from a polymeric material;

a colored disc mounted in said bezel on the upperside of said bottom wall;

a clear, plastic simulated gem mounted in said bezel on top of said disc, whereby said disc will impart its color to said simulated gem; and means for mounting said simulated gem in said bezel in a manner such that a small child cannot remove said simulated gem from said bezel, comprising:

a pair of elongated openings in said bottom wall closely adjacent said collar, said openings being spaced approximately 180° apart; and a pair of J-shaped clips depending from said simulated gem, said clips being constructed and arranged in a manner such that each clip may be inserted through an associated one of said openings, whereupon said clips will spring outwardly into locking engagement with the underside of said collar.

2. A child's simulated jewelry item as recited in claim 1 wherein said simulated gem includes a planar lower surface, a facetted frusto-conical portion extending above said lower surface and a facetted upper surface on top of said frusto-conical portion.

* * * * *